US007415946B2

(12) United States Patent
Merchant et al.

(10) Patent No.: US 7,415,946 B2
(45) Date of Patent: Aug. 26, 2008

(54) ENGINE AND METHOD FOR OPERATING AN ENGINE

(75) Inventors: Jack Merchant, Peoria, IL (US); Paul Olsen, Chillicothe, IL (US); Scott Wallington, Sparland, IL (US); Thomas Meyer, II, Peoria, IL (US); Earl Pilgrim, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 39 days.

(21) Appl. No.: 11/411,799

(22) Filed: Apr. 27, 2006

(65) Prior Publication Data

US 2007/0251470 A1 Nov. 1, 2007

(51) Int. Cl.
*F01P 1/06* (2006.01)

(52) U.S. Cl. ..... 123/41.31; 123/196 R

(58) Field of Classification Search ..... 123/41.31, 123/196 R

See application file for complete search history.

(56) References Cited

U.S. PATENT DOCUMENTS

| | | | | |
|---|---|---|---|---|
| 2,037,778 | A | | 4/1936 | Goode et al. |
| 2,898,895 | A | | 8/1959 | Koppel et al. |
| 3,063,435 | A | | 11/1962 | Maurer et al. |
| 3,945,353 | A | * | 3/1976 | Dreisin ..... 123/41.31 |
| 5,503,116 | A | | 4/1996 | Wolf |
| 5,509,381 | A | | 4/1996 | Fisher |
| 5,983,843 | A | | 11/1999 | Suzuki et al. |
| 6,481,392 | B1 | | 11/2002 | Etemad |
| 6,612,272 | B2 | | 9/2003 | Kato et al. |

FOREIGN PATENT DOCUMENTS

| | | | |
|---|---|---|---|
| DE | 24 38 193 | | 2/1976 |
| DE | 2846929 | A * | 5/1979 |
| GB | 840588 | | 7/1960 |
| GB | 2 000 223 | A | 1/1979 |
| JP | 1-114917 | | 8/1989 |
| JP | 7-332194 | | 12/1995 |

OTHER PUBLICATIONS

Volvo, Parts Catalog A40D Part1 Group 1-4, publication No. VOE 6396697821, pp. 70-77.

PCT International Search Report, Applicant Ref. No. 06-291, International Application No. PCT/US2007/006080; International Filing Date: Mar. 9, 2007; Applicant: Caterpillar Inc.

* cited by examiner

*Primary Examiner*—Noah Kamen
(74) *Attorney, Agent, or Firm*—Finnegan, Henderson, Farabow, Garrett & Dunner

(57) ABSTRACT

An engine includes a housing having a combustion chamber. The engine may also include a fuel injector for supplying fuel directly or indirectly to the combustion chamber. Additionally, the engine may include an engine-lubricant-supply system operable to discharge engine lubricant onto the fuel injector.

22 Claims, 2 Drawing Sheets

ENGINE AND METHOD FOR OPERATING AN ENGINE

TECHNICAL FIELD

The present disclosure relates to engines and, more particularly, to engines employing fuel injection technology.

BACKGROUND

Many systems use engines to produce power for performing various tasks. Engines often produce power by combusting fuel in one or more combustion chambers and transferring energy generated by combusting the fuel to a power load. Many engines employ fuel injectors to supply fuel directly or indirectly to their combustion chambers. Various sources of heat may increase the temperatures of the fuel injectors of an engine when the engine is producing power. In some circumstances, the fuel injectors may reach undesirably high temperatures that may hinder operation of the fuel injectors or even damage the fuel injectors.

U.S. Pat. No. 2,037,778 to Goode et al. ("the '778 patent") shows an engine with provisions for cooling a fuel injector. The engine of the '778 patent includes a cylinder block and a cylinder head enclosing a combustion chamber above a piston disposed in a cylinder of the cylinder block. The fuel injector of the '778 patent extends through a passage in the cylinder head and a discharge end of the fuel injector is disposed inside the combustion chamber. The engine of the '778 patent also includes a conduit for supplying cooling fluid. The outlet of the conduit is disposed adjacent and directed toward the discharge end of the fuel injector. A portion of the cylinder head separates the outlet of the conduit from the fuel injector.

Although the engine of the '778 patent includes a conduit for supplying cooling fluid to a portion of the cylinder head disposed adjacent the discharge end of the fuel injector, certain disadvantages persist. For example, because a portion of the cylinder head separates the outlet of the conduit from the fuel injector, heat from the fuel injector must travel through that portion of the cylinder head before it can be carried away by cooling fluid discharged from the conduit. Thus, the portion of the cylinder head separating the fuel injector from the cooling fluid discharged by the conduit may impede cooling of the fuel injector.

The engine and methods of the present disclosure solve one or more of the problems set forth above.

SUMMARY OF THE INVENTION

One disclosed embodiment relates to an engine that includes a housing having a combustion chamber. The engine may also include a fuel injector for supplying fuel directly or indirectly to the combustion chamber. Additionally, the engine may include an engine-lubricant-supply system operable to discharge engine lubricant onto the fuel injector.

Another embodiment relates to a method of operating an engine. The method may include producing power with the engine by supplying fuel directly or indirectly to a combustion chamber of the engine with a fuel injector and combusting the fuel in the combustion chamber. The method may also include cooling the fuel injector by directing engine lubricant onto the fuel injector while producing power with the engine.

A further embodiment relates to an engine that includes a housing having a combustion chamber. The engine may also include a fuel injector for supplying fuel directly or indirectly to the combustion chamber. Additionally, the engine may include a valve for selectively allowing fluid flow to or from the combustion chamber. The engine may also include a valve-actuation system for actuating the valve. Additionally, the engine may include an engine-lubricant-supply system having an outlet on the valve actuation system, the outlet being directed at the fuel injector.

DETAILED DESCRIPTION

Figure 1:
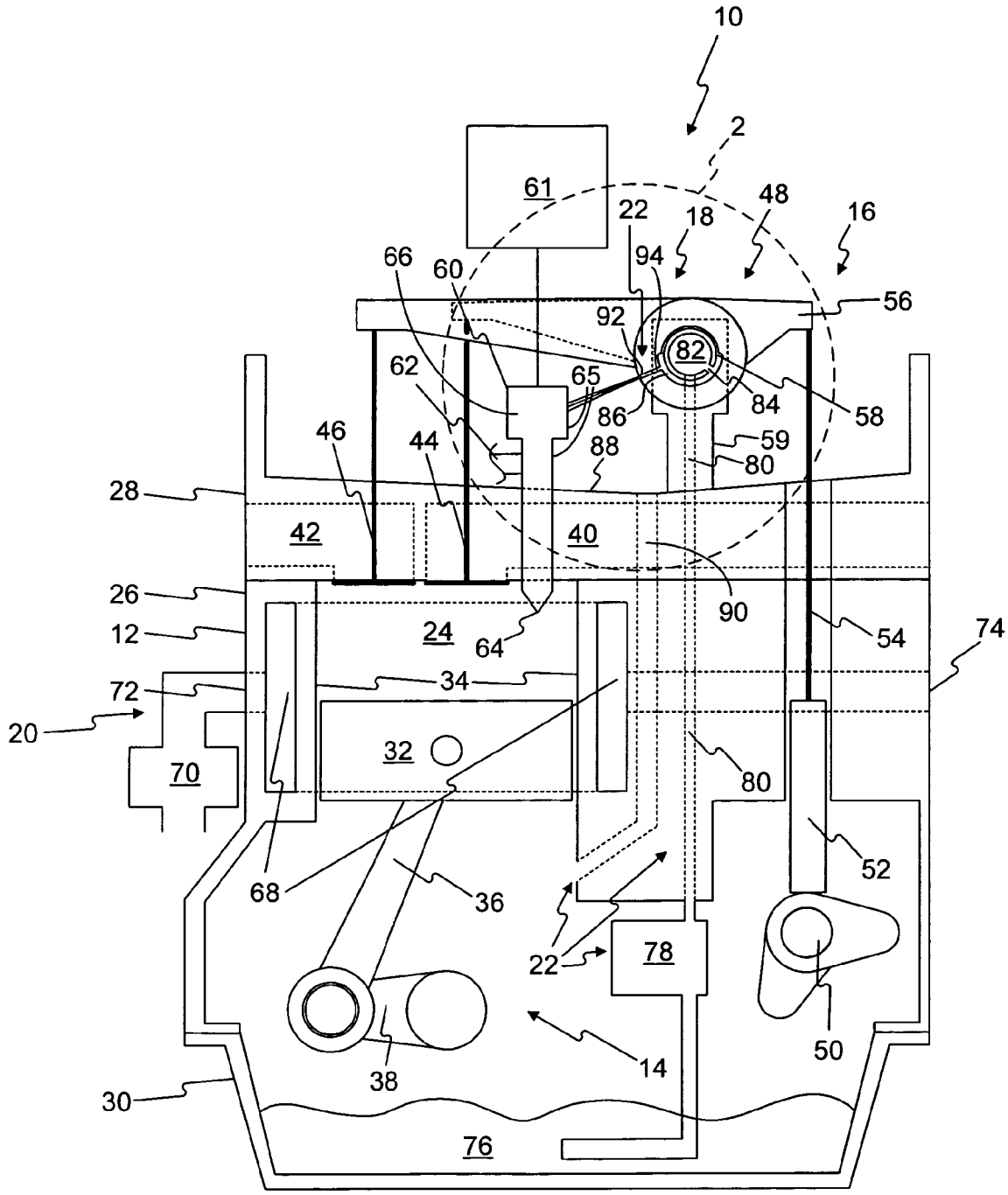
FIG. 1 is a diagrammatic illustration of an engine according to the present disclosure.
Figure 2:
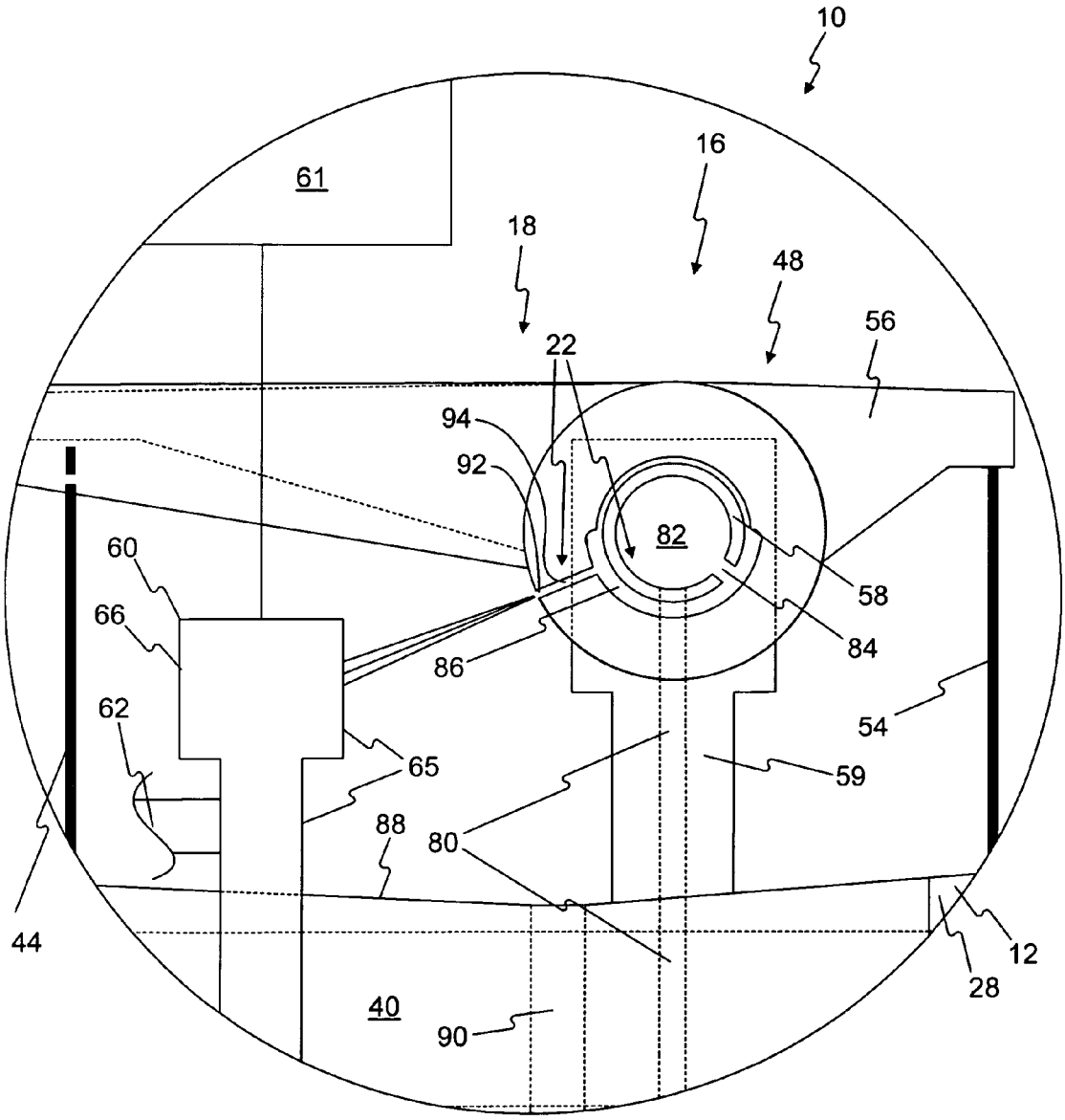
FIG. 2 is an enlarged view of the portion of FIG. 1 in circle 2.

FIGS. 1 and 2 illustrate one embodiment of an engine 10 according to the present disclosure. Engine 10 may include a housing 12, a power-transfer system 14, an aspiration system 16, engine controls 18, a cooling system 20, and an engine-lubricant-supply system 22.

Housing 12 may include a combustion chamber 24 wherein engine 10 may combust fuel to produce power. Housing 12 may also include various other features serving various other roles, some of which are described below. In some embodiments, housing 12 be constructed of multiple pieces fastened together. For example, as FIG. 1 shows, housing 12 may include a block 26, a head 28, and a sump 30 fastened together.

Power-transfer system 14 may include any component or components operable to extract energy from combustion that occurs in combustion chamber 24 and transfer at least a portion of that energy to a power load. As FIG. 1 shows, in some embodiments, power-transfer system 14 may include a piston 32 disposed in a cylinder 34 of housing 12 adjacent combustion chamber 24. Power-transfer system 14 may also include a connecting rod 36 and a crankshaft 38 connected to piston 32 and supported by housing 12 in a conventional manner.

The general configuration of housing 12 and power-transfer system 14 is not limited to that shown in FIG. 1. For example, housing 12 may include other combustion chambers in addition to combustion chamber 24. Additionally, in place of connecting rod 36 and crankshaft 38, power-transfer system 14 may include other types of mechanical linkages connected to piston 32. Furthermore, in some embodiments, engine 10 may be a type of engine wherein power-transfer system 14 does not include piston 32, such as, for example, a Wankel-type rotary engine, in which case power-transfer system 14 may include a rotor, instead of piston 32. Additionally, in some embodiments, power-transfer system 14 may be configured to transfer power through means other than mechanical components, such as fluid or magnetic fields.

Aspiration system 16 may be configured to deliver charge gas to combustion chamber 24 and direct exhaust gas away from combustion chamber 24. Aspiration system 16 may include an intake passage 40 and an exhaust passage 42 of housing 12. Each of intake passage 40 and exhaust passage 42 may extend from combustion chamber 24 to an opening in an exterior surface of housing 12. In some embodiments, intake passage 40 may be connected to a charge-gas-intake system (not shown) configured to deliver charge gas to intake passage 40. Such a charge-gas intake system may include various gas-transfer components, including, but not limited, to passages, chambers, valves, throttles, compressors, and/or heat exchangers. Similarly, in some embodiments, exhaust passage 42 may be connected to an exhaust system (not shown) configured to direct exhaust gas away from exhaust passage 42. Such an exhaust system may include various gas-transfer components, including, but not limited to, passages, chambers, mufflers, and/or gas-treatment devices.

Aspiration system 16 may also include an intake valve 44 and an exhaust valve 46. Intake valve 44 may be operable to control fluid flow between combustion chamber 24 and intake passage 40. Similarly, exhaust valve 46 may be operable to control fluid flow between combustion chamber 24 and exhaust passage 42. As FIGS. 1 and 2 show, in some embodiments, intake valve 44 and exhaust valve 46 may be poppet valves. In some embodiments, intake valve 44 and exhaust valve 46 may be biased toward a closed operating state by conventional valve springs (not shown).

Aspiration system 16 may also include a valve-actuation system 48 configured to actuate intake valve 44 and exhaust valve 46. Valve-actuation system 48 may be configured to actuate intake valve 44 in such a manner to selectively allow charge gas to flow from intake passage 40 into combustion chamber 24. Similarly, valve-actuation system 48 may be configured to actuate exhaust valve 46 to selectively allow exhaust gas to flow from combustion chamber 24 into exhaust passage 42.

Valve-actuation system 48 may include any combination of mechanical actuators, hydraulic actuators, pneumatic actuators, electrical actuators, magnetic actuators, and/or other types of actuators operable to actuate valves 44, 46 in a suitable manner. In some embodiments, valve-actuation system 48 may include a valve train, such as, for example, the one shown in FIGS. 1 and 2. Valve-actuation system 48 may include a camshaft 50. Additionally, for each of intake valve 44 and exhaust valve 46, valve-actuation system 48 may include a camshaft follower 52, a pushrod 54, and a rocker arm 56. Each rocker arm 56 may be pivotally mounted to a rocker shaft 58 supported by a rocker-shaft support 59 (FIG. 2).

Aspiration system 16 is not limited to the configuration shown in FIGS. 1 and 2. For example, intake passage 40 and/or exhaust passage 42 may have different configurations and/or extend through different portions of housing 12. Additionally, aspiration system 16 may include other intake passages and/or intake valves in addition to intake passage 40 and intake valve 44. Similarly, aspiration system 16 may include other exhaust passages and/or exhaust valves in addition to exhaust passage 42. Furthermore, valve-actuation system 48 may include a different configuration of valve train than that shown in FIGS. 1 and 2, such as, for example, an overhead-camshaft-type valve train or a valve train of the type commonly used in flathead engine configurations. Moreover, in some embodiments, valve-actuation system 48 may include one or more hydraulic, pneumatic, electrical, magnetic, and/or other types of actuators in addition to, or in place, of a conventional valve train. Additionally, in some embodiments, valve-actuation system 48 may include a compression-braking mechanism configured to alter actuation of exhaust valve 46 in such a manner to cause engine 10 to perform compression braking. Additionally, one or both of intake valve 44 and exhaust valve 46 may be a type of valve other than a poppet valve, such as, for example, a ball valve or a spool valve. Furthermore, in some embodiments, aspiration system 16 may omit one or both of intake valve 44 and exhaust valve 46.

Engine controls 18 may include any components operable to control the operation of engine 10. For example, engine controls 18 may include intake valve 44, exhaust valve 46, valve-actuation system 48, a fuel injector 60, and a controller 61. Fuel injector 60 may include an inlet 62 connected to a fuel supply (not shown) and an outlet 64 from which fuel injector 60 selectively discharges fuel. Fuel injector 60 may also include various components, such as one or more valve members (not shown) and/or one or more pistons (not shown) collectively operable to selectively cause discharge of fuel from outlet 64. Additionally, engine controls 18 may include mechanical, hydraulic, pneumatic, electrical, magnetic, and/or other suitable types of actuators for actuating components of fuel injector 60. For example, in some embodiments, fuel injector 60 may include an electric solenoid 66 operable to actuate one or more components of fuel injector 60 to cause fuel injector 60 to discharge fuel. Additionally, in some embodiments, fuel injector 60 may be configured to utilize one or more fluids, such as engine lubricant or fuel, to actuate one or more components thereof.

Fuel injector 60 may be mounted to engine 10 in such a manner that fuel injector 60 may be employed to supply fuel to combustion chamber 24 through outlet 64. For example, as FIGS. 1 and 2 show, outlet 64 of fuel injector 60 may be disposed inside combustion chamber 24 so that fuel injector 60 may supply fuel directly into combustion chamber 24, and an exposed portion 65 of fuel injector 60 may be disposed outside combustion chamber 24. Alternatively, fuel injector 60 may be mounted with outlet 64 disposed inside intake passage 40 or some component of a charge-gas-intake system connected thereto so that fuel injector 60 may indirectly supply fuel to combustion chamber 24 through intake passage 40.

Controller 61 may be any type of information-processing device. Controller 61 may include one or more processors (not shown) and or one memory devices (not shown). Controller 61 may be operatively connected to and configured to control various components of engine 10. For example, as FIGS. 1 and 2 show, controller 61 may be operatively connected to fuel injector 60 and configured to control discharge of fuel by fuel injector 60. Controller 61 may also be operatively connected to various sources of information, such as sensors and/or other controllers.

Engine controls 18 are not limited to the configuration shown in FIGS. 1 and 2. Engine controls 18 may have provisions other than controller 61 for controlling discharge of fuel by fuel injector 60. For example, in some embodiments, engine controls 18 may include exclusively mechanical provisions for controlling discharge of fuel by fuel injector 60. In some embodiments, engine controls 18 may omit controller 61. Additionally, engine controls 18 may include various other components not shown in FIGS. 1 and 2, such as an ignition system in embodiments where engine 10 is a spark-ignition-type engine.

Cooling system 20 may be configured to provide liquid cooling of engine 10. In some embodiments, cooling system 20 may include a cooling jacket 68 of housing 12 with liquid coolant disposed therein. Additionally, cooling system 20 may include a pump 70 for pumping liquid coolant into an inlet 72 of cooling jacket 68, through cooling jacket 68, and out of an outlet 74 of cooling jacket 68. In some embodiments, cooling system 20 may also include an engine-lubricant cooler (not shown) configured to transfer heat from engine lubricant to the cooling liquid of cooling system 20. Cooling system 20 may include various provisions for ensuring that the temperature of its cooling liquid is sufficiently low to adequately cool engine 10. For example, cooling system 20 may have a heat exchanger (not shown) connected between outlet 74 and inlet 72. Alternatively, cooling system 20 may continuously draw its cooling liquid from a substantially inexhaustible source of cool liquid, such as a river, lake, or ocean in marine applications.

Engine-lubricant-supply system 22 may be any system configured to supply engine lubricant to one or more components of engine 10. Engine-lubricant-supply system 22 may supply engine lubricant to components of engine 10 for lubrication purposes and/or for various other purposes, some of which are discussed below. In some embodiments, engine-lubricant-supply system 22 may include an engine-lubricant reserve 76, provisions for supplying engine lubricant from engine-lubricant reserve 76 to various components of engine 10, and provisions for returning engine lubricant from those components to engine-lubricant reserve 76.

The provisions for supplying engine lubricant from engine-lubricant reserve 76 to various components of engine 10 may include an engine-lubricant pump 78 and various engine-lubricant-supply passages extending from engine-lubricant pump 78 to various components of engine 10. For example, engine-lubricant-supply system 22 may include an engine-lubricant-supply passage 80 extending from engine-lubricant pump 78 through housing 12 and rocker-shaft support 59 to an engine-lubricant-supply passage 82 extending through rocker shaft 58. As is best seen in FIG. 2, for each rocker arm 56, engine-lubricant system 22 may also include an engine-lubricant-supply passage 84 extending through the rocker shaft 58. Additionally, engine-lubricant-supply system 22 may include an engine-lubricant-supply passage 86 in fluid communication with engine-lubricant-supply passage 84 and extending along the interface between rocker arm 56 and rocker shaft 58.

In addition to the provisions shown in FIGS. 1 and 2, engine-lubricant-supply system 22 may have provisions (not shown) for supplying engine lubricant to various other parts of engine 10. For example, engine-lubricant-supply system 22 may include provisions (not shown) for providing engine lubricant to components such as power-transfer system 14 and various other parts of valve-actuation system 48 to lubricate those components.

Additionally, in some embodiments, engine-lubricant-supply system 22 may have provisions (not shown) for supplying engine lubricant to other components of engine 10 for purposes other than lubrication. For example, in embodiments where cooling system 20 includes an engine-lubricant cooler, engine-lubricant-supply system 22 may include provisions for supplying engine lubricant to the engine-lubricant cooler to be cooled. Additionally, in some embodiments, engine-lubricant-supply system 22 may have provisions for supplying engine lubricant to fuel injector 60 for use in actuating components thereof and/or provisions for supplying engine lubricant to one or more actuators of valve-actuation system 48 for use in valve actuation. In some embodiments where engine-lubricant-supply system 22 includes provision for supplying engine lubricant for purposes other than lubrication, those provisions may be separate from provisions for supplying engine lubricant for lubrication. For example, in addition to engine-lubricant pump 78 and engine-lubricant-supply passages 80, 82, 84, 86 connected thereto, engine-lubricant-supply system 22 may include an additional engine-lubricant pump (not shown) and additional engine-lubricant-supply passages (not shown) dedicated to supplying engine lubricant to one or more components for a purpose other than lubrication.

The provisions for returning engine-lubricant to engine-lubricant reserve 76 may include various surfaces, channels, and/or passages configured to direct engine lubricant back to engine-lubricant reserve 76. For example, engine-lubricant-supply system 22 may include a catch surface 88, and an engine-lubricant-return passage 90 for catching engine-lubricant discharged from valve-actuation system 48 and returning the engine lubricant to engine-lubricant reserve 76. In such embodiments, engine-lubricant-supply system 22 may rely on gravity to draw engine lubricant discharged from valve-actuation system 48 back to engine-lubricant reserve 76. In some, embodiments, engine-lubricant-supply system 22 may use on one or more pressure sources, such as engine-lubricant pump 78 to drive engine lubricant back to engine-lubricant reserve 76.

Engine-lubricant-supply system 22 may also include provisions for directing engine lubricant onto fuel injector 60. These provisions may include an outlet 92 configured to discharge engine lubricant in such a manner that the engine lubricant will impinge upon exposed portion 65 of fuel injector 60. Outlet 92 may be disposed anywhere on engine 10 such that outlet 92 may be supplied with engine lubricant from some part of engine-lubricant-supply system 22. As is best seen in FIG. 2, in some embodiments, outlet 92 may be on rocker arm 56, and engine-lubricant-supply system 22 may include an engine-lubricant-supply passage 94 supplying engine lubricant from engine-lubricant-supply passage 86, through rocker arm 56, to outlet 92. As FIG. 2 shows, outlet 92 may be directed at fuel injector 60 and engine-lubricant-supply system 22 may be configured to discharge engine lubricant from outlet 92 with sufficient velocity that fuel injector 60 is within the trajectory of the engine lubricant.

The provisions of engine-lubricant-supply system for discharging engine lubricant onto fuel injector 60 are not limited to the configuration shown in FIGS. 1 and 2. For example, outlet 92 may be on different components of engine 10. Outlet 92 may be on a component of valve-actuation system 48 other than rocker arm 56, such as, for example, rocker shaft 58. Furthermore, in embodiments where valve-actuation system 48 includes one or more actuators that utilize engine lubricant for valve actuation, outlet 92 may be on one or more of those actuators. Similarly, in embodiments where fuel injector 60 uses engine lubricant for actuating one or more components thereof, outlet 92 may be on the exterior surface of fuel injector 60. Additionally, in embodiments where aspiration system 16 includes a compression-braking mechanism, outlet 92 may be on the compression-braking mechanism. Furthermore, outlet 92 may be on a surface of housing 12. Moreover, in some embodiments outlet 92 may be a gap between two components of engine 10.

Additionally, in some embodiments, outlet 92 may not be directed at fuel injector 60. In such embodiments, engine-lubricant-supply system 22 may include various provisions for directing engine lubricant from outlet 92 onto fuel injector 60. For example, engine-lubricant-supply system 22 may include one or more components dedicated to directing engine lubricant from outlet 92 onto fuel injector 60, such as a chute or a formed tube. Additionally, in some embodiments, engine-lubricant-supply system 22 may include one or more features on components of other systems of engine 10 for directing engine lubricant discharged from outlet 92 onto fuel injector 60, such as channels and/or deflector surfaces.

Furthermore, rather than a single outlet 92 for discharging engine lubricant onto fuel injector 60, engine-lubricant-supply system 22 may include multiple outlets configured to discharge engine lubricant onto fuel injector 60. In such embodiments, the multiple outlets for discharging engine lubricant onto fuel injector 60 may all be on the same component of engine 10, or they may be on multiple components of engine 10.

INDUSTRIAL APPLICABILITY

Engine 10 may have application wherever power is required to perform one or more tasks. Engine controls 18 may cause engine 10 to produce power by causing delivery of charge gas to combustion chamber 24 by aspiration system 16, direct or indirect supply of fuel to combustion chamber 24 by fuel injector 60, and combustion of the fuel in combustion chamber 24. Engine controls 18 may implement any of numerous specific varieties of this process of producing power, including, but not limited to, a four-cycle compression-ignition process, a two-cycle compression-ignition process, a four-cycle spark-ignition process, and a two-cycle spark-ignition process.

As engine controls 18 cause engine 10 to produce power, various sources of heat may increase the temperature of fuel injector 60. Fuel injector 60 may absorb heat from combustion in combustion chamber 24. In embodiments wherein outlet 64 of fuel injector 60 is disposed in combustion chamber 24, heat from combustion may flow into fuel injector 60 at a particularly high rate. Additionally, using fluid, such as engine lubricant and/or fuel, to actuate components inside fuel injector 60 in order to cause fuel injector 60 to discharge fuel may generate significant heat. Furthermore, in embodiments where fuel injector 60 includes electric solenoid 66, electric current flowing through electric solenoid 66 may generate considerable heat. If the temperature of fuel injector 60 gets too high, fuel injector 60 may not perform properly and/or fuel injector 60 may be damaged. For example, if the temperature of fuel injector 60 rises above certain levels, electric solenoid 66 may fail to operate properly. Exposed portion 65 of fuel injector 60 may be particularly prone to reaching undesirably high temperatures because heat may exit exposed portion 65 only by transferring to the adjacent air or by flowing a considerable distance through fuel injector 60 to housing 12.

While engine 10 is producing power, engine-lubricant-supply system 22 may cool fuel injector 60 by discharging engine lubricant onto fuel injector 60. In the embodiment of engine 10 illustrated in FIGS. 1 and 2, engine-lubricant pump 78 may pump engine lubricant through engine-lubricant-supply passages 80, 82, 84, 86, 94 and outlet 92 onto fuel injector 60. In some embodiments, engine-lubricant pump 78 may pump engine lubricant substantially continuously when engine 10 is producing power, in which case, engine-lubricant-supply system 22 may discharge engine lubricant onto fuel injector 60 substantially continuously while engine 10 is producing power. Additionally, in some embodiments and/or circumstances engine-lubricant-supply system 22 may discharge engine lubricant onto fuel injector 60 at a rate greater than 50 milliliters per minute.

Various aspects of the disclosed embodiments may promote particularly effective cooling of fuel injector 60. By impinging directly on fuel injector 60 and convecting heat directly away from it, the engine lubricant discharged from outlet 92 may transfer heat away from fuel injector 60 at a particularly rapid rate. Discharging engine lubricant substantially continuously onto fuel injector 60 and discharging engine-lubricant onto fuel injector 60 at a rate greater than 50 milliliters per minute may further enhance cooling of fuel injector 60. Additionally, in embodiments where outlet 92 is on rocker arm 56, the stream of engine lubricant impinging on fuel injector 60 may continually sweep across the exterior of fuel injector 60, thereby promoting uniform cooling of fuel injector 60. Furthermore, directing engine lubricant onto exposed portion 65 of fuel injector 60 may be particularly beneficial because, as was discussed above, exposed portion 65 of fuel injector 60 may have a greater need for cooling than other portions of fuel injector 60.

The disclosed embodiments may also provide cost-effective, low-risk cooling of fuel injector 60. Because the liquid used by the disclosed embodiments to cool fuel injector 60 is engine lubricant, it cannot contaminate the engine lubricant delivered to other components of engine 10 for lubrication purposes. As a result, the disclosed embodiments allow liquid cooling of fuel injector 60 without the need for expensive provisions for isolating the liquid coolant from the engine-lubricant-supply system 22. Additionally, providing outlet 92 in a component of engine 10 that is lubricated by engine-lubricant-supply system 22 may be a cost-effective way to direct engine lubricant onto fuel injector 60 for cooling purposes.

It will be apparent to those skilled in the art that various modifications and variations can be made in the disclosed engine and methods without departing from the scope of the disclosure. Other embodiments of the disclosed engine and methods will be apparent to those skilled in the art from consideration of the specification and practice of the engine and methods disclosed herein. It is intended that the specification and examples be considered as exemplary only, with a true scope of the disclosure being indicated by the following claims and their equivalents.

What is claimed is:

1. An engine, comprising:

a housing having a combustion chamber;

a fuel injector for supplying fuel directly or indirectly to the combustion chamber; and an engine-lubricant-supply system operable to discharge engine lubricant onto an exposed upper portion of the fuel injector such that the engine lubricant flows down the fuel injector.

2. The engine of claim 1, wherein the engine-lubricant-supply system is operable to discharge engine lubricant onto the fuel injector substantially continuously when the engine is producing power.

3. The engine of claim 1, wherein the engine-lubricant-supply system is operable to discharge engine lubricant onto the fuel injector at a rate greater than about 50 milliliters per minute.

4. The engine of claim 1, wherein:

the engine-lubricant-supply system includes an outlet directed at the fuel injector; and the engine-lubricant-supply system is operable to discharge engine lubricant from the outlet onto the fuel injector.

5. The engine of claim 1, further including:

a valve for selectively allowing fluid flow into or out of the combustion chamber;

a valve-actuation system operable to actuate the valve;

wherein the engine-lubricant-supply system includes an outlet on the valve-actuation system, the outlet being directed at the fuel injector so that engine lubricant flows through the outlet onto the fuel injector.

6. The engine of claim 1, further including:

a valve for selectively allowing fluid flow into or out of the combustion chamber;

a valve-actuation system operable to actuate the valve, the valve-actuation system including a rocker arm;

wherein the engine-lubricant-supply system includes an outlet on the rocker arm, the outlet being directed at the fuel injector so that engine lubricant flows through the outlet onto the fuel injector.

7. The engine of claim 1, wherein:

the fuel injector includes an outlet disposed inside the combustion chamber; and the engine-lubricant-supply system is operable to discharge engine lubricant onto an exposed portion of the fuel injector disposed outside of the combustion chamber.

8. The engine of claim 1, wherein the engine-lubricant-supply system is operable to discharge engine lubricant onto the fuel injector by continually sweeping across the fuel injector.

9. A method of operating an engine, including:

producing power with the engine by supplying fuel directly or indirectly to a combustion chamber of the engine with a fuel injector; and combusting the fuel in the combustion chamber; and while producing power with the engine, cooling the fuel injector by spraying engine lubricant onto the fuel injector.

10. The method of claim 9, wherein directing engine lubricant onto the fuel injector includes discharging engine lubricant out of an outlet directed at the fuel injector.

11. The method of claim 9, wherein directing engine lubricant onto the fuel injector includes pumping engine lubricant through one or more engine-lubricant-supply passages of the engine and an outlet directed at the fuel injector.

12. The method of claim 9, wherein directing engine lubricant onto the fuel injector includes directing engine lubricant through one or more engine-lubricant-supply passages in a valve-actuation system of the engine and an outlet on the valve-actuation system onto the fuel injector.

13. The method of claim 9, wherein:

the fuel injector includes an outlet disposed inside the combustion chamber; and directing engine lubricant onto the fuel injector includes directing engine lubricant onto an exposed portion of the fuel injector disposed outside the combustion chamber.

14. The method of claim 9, wherein directing engine lubricant onto the fuel injector includes directing engine lubricant onto the fuel injector at a rate of more than 50 milliliters per minute.

15. The method of claim 9, wherein directing engine lubricant onto the fuel injector includes directing engine lubricant onto the fuel injector substantially continuously while producing power with the engine.

16. The method of claim 9, further including:

while producing power with the engine, cooling the engine with a liquid other than engine lubricant.

17. The method of claim 9, wherein cooling includes cooling the fuel injector by continually sweeping engine lubricant back and forth across the fuel injector.

18. An engine, comprising:

a housing having a combustion chamber;

a fuel injector for supplying fuel directly or indirectly to the combustion chamber;

a valve for selectively allowing fluid flow to or from the combustion chamber;

a valve-actuation system for actuating the valve; and an engine-lubricant-supply system having an outlet on the valve-actuation system, the outlet being directed at the fuel injector and configured to discharge engine lubricant on the fuel injector, the outlet disposed apart from the fuel injector.

19. The engine of claim 18, wherein:

the valve-actuation system includes a rocker arm; and the outlet is on the rocker arm.

20. The engine of claim 18, wherein the engine-lubricant-supply system is operable to discharge engine lubricant from the outlet at sufficient velocity that the fuel injector is within the trajectory of the engine lubricant discharged from the outlet.

21. The engine of claim 18, wherein the engine-lubricant-supply system is operable to discharge engine lubricant from the rocker arm at a rate greater than 50 milliliters per minute.

22. The engine of claim 18, wherein the engine includes a cooling system operable to cool the engine with a liquid other than engine lubricant.

* * * * *